United States Patent [19]

Schmidt

[11] 4,266,835

[45] May 12, 1981

[54] COMPACT POSITION LOCK TOOL BOX

[76] Inventor: LaVern Schmidt, P.O. Box 234, Montezuma, Kans. 60867

[21] Appl. No.: 72,035

[22] Filed: Sep. 4, 1979

[51] Int. Cl.[3] ..... A47B 96/06

[52] U.S. Cl. ..... 312/244; 312/39; 312/DIG. 33

[58] Field of Search ..... 312/DIG. 33, 37–39, 312/42, 209, 244

[56] References Cited

U.S. PATENT DOCUMENTS

| | | | |
|---|---|---|---|
| 1,510,240 | 9/1924 | Myers | 312/DIG. 33 |
| 2,046,244 | 6/1936 | Carner | 312/DIG. 33 |
| 2,386,573 | 10/1945 | Randall | 312/DIG. 33 |
| 2,582,812 | 1/1952 | Wise | 312/39 |
| 3,012,658 | 12/1961 | Flora | 312/DIG. 33 |
| 3,025,829 | 3/1962 | Smith | 312/39 |

*Primary Examiner*—Casmir A. Nunberg
*Attorney, Agent, or Firm*—Richard L. Miller

[57] ABSTRACT

A tool chest, including specific locations therein for placement of various tools, the chest having a compartmented case and hinged cover, a row of hooks from which some tools are hung and a perforated shelf through which some other of the tools are fitted, and the cover in a closed position preventing the tools from falling out of the compartments, off the hooks and out of the shelf holes in case the chest is overturned.

5 Claims, 3 Drawing Figures

10
12
14
15
16
17
11
2

31
32
13
30
38
39
12
17
15
14
18
41
41
11
26
21
25
19
23

40
17
33
12
31
30
32
16
18
29
28
27
29
39
38
11
37
25
35
41
16
19
34
17
26
22
20
21
24
23
14

COMPACT POSITION LOCK TOOL BOX

BACKGROUND OF THE INVENTION

This invention relates generally to tool chests. It is well known that most tool chests such as are used by mechanics and, carpenters or other craftsmen, are loaded with a large variety of tools, so that if the chest is accidently turned over, all the tools are displaced from their proper locations inside the chest, and finding a specific tool is then more difficult. This is therefore in need of an improvement.

SUMMARY OF THE INVENTION

Accordingly it is a principal object of the present invention to provide a tool box which supports some tools in compartments, other suspended from hooks, and still others fitted in holes through a shelf and wherein none of the tools are displaced from their location, in case the tool box is overturned when the case cover is closed.

Another object is to provide a tool box which is compact and convenient to carry.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF PREFERRED EMBODIMENT

Figure 1:
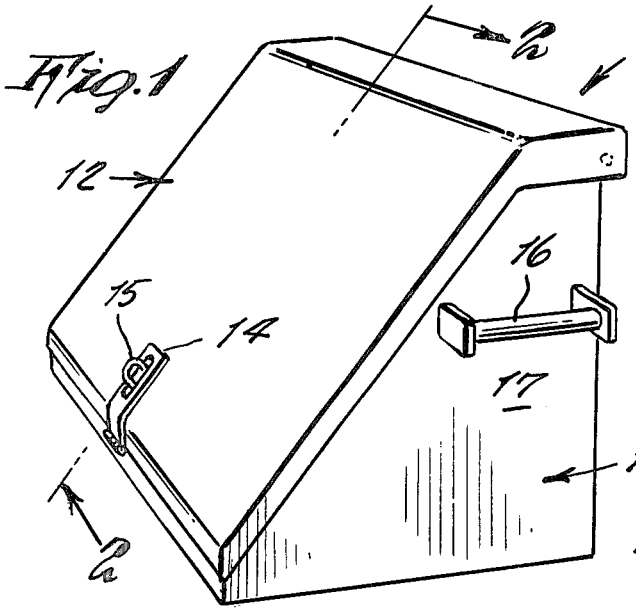
FIG. 1 is a perspective view of the invention shown with lid closed.

Referring now to the drawing in greater detail, the reference numeral 10 represents a tool box, according to the present invention, wherein there is a sheet metal case 11 and sheet metal cover 12 attached thereto by hinges 13 and locked by a hasp 14 swinged over a staple 15. Carrying handles 16 are on each side end wall 17 of the case, the side walls being triangular in shape.

The case additionally includes a rear wall 18, and a bottom wall 19 which along its forward edge has an upwardly turned flange so to form a very low front wall 20 to which the hasp is secured.

Inside the case, partitions 21 and 22 form compartments 23 and 24 upon the bottom and which are closable by a lid 25 pivotable about hinges 26.

A shelf 27 across the case has rows of holes 28 at one and thereof for receiving and retaining tools such as screwdrivers and punches whose handles rest upon the shelf while to tool shanks protrude down through the holes.

An opposite end of the shelf is inclosed by partitions 29, rear wall 30 and an inclined top wall 31 so to form compartments 32 and 33 upon the shelf.

A compartment 34 under the shelf formed by side walls 35 and bottom wall 36 serves to hold a plastic bottle 37 of hand cleaner compound, or the like.

A spindle 38 removably held between brackets 39 on an underside of the shelf serves to hold a roll of paper towelling.

Figure 2:
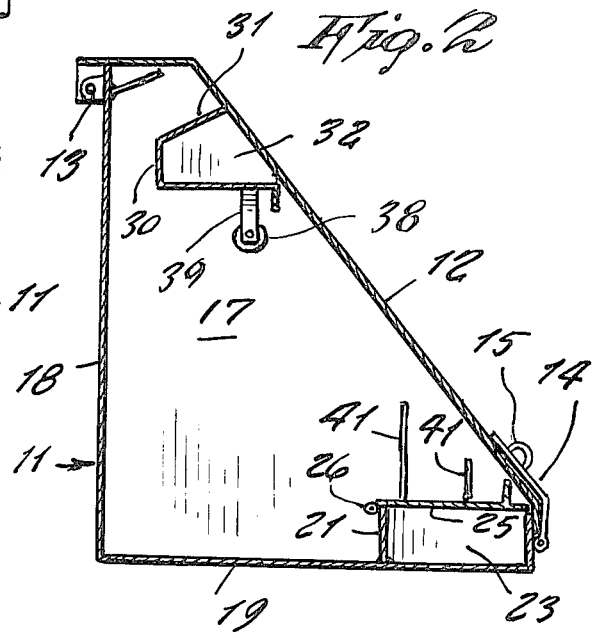
FIG. 2 is a side cross sectional view on line 2—2 of FIG. 1.
Figure 3:
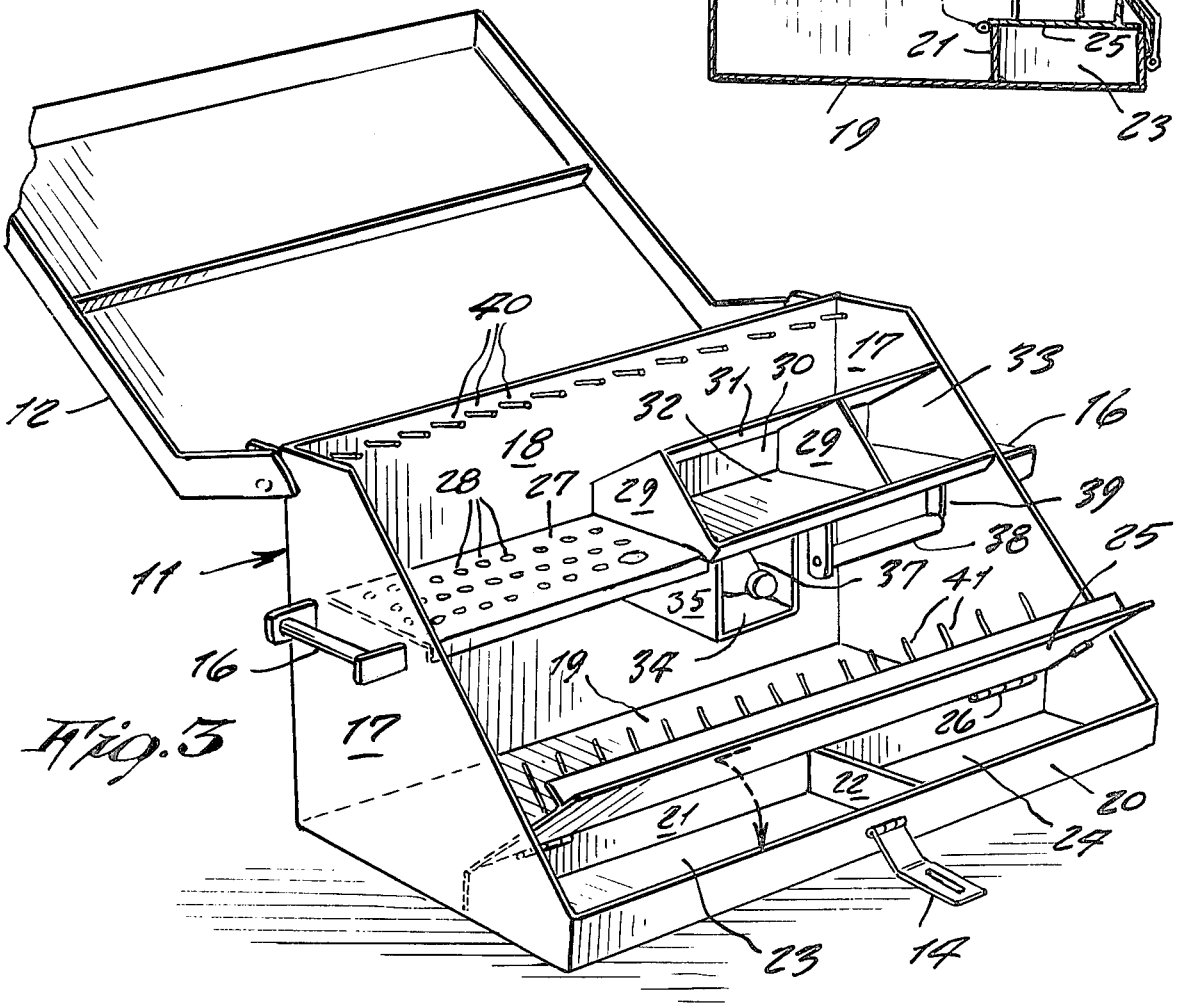
FIG. 3 is a perspective view of the invention, shown with lid open.

A row of upwardly inclined pegs 40 along an upper end of the case rear wall 18 serves to suspend tools having a hole in one end thereof so as to hook upon the pegs (see FIG. 2). Such tools may comprise closed fixed box wrenches or other tools having a hole or a ring on a handle end thereof. Pegs 41 on the lid 25 serve to hold collars, sockets and the like.

As clearly shown in FIG. 2, when the cover 12 is in a closed position, it closes the compartments 32 and 33 as well as the case areas above and below the shelf. Additionally it prevents lid 25 from swinging open via contact with at least some of the pegs 41. Additionally it prevents tools in the holes 28 from sliding upward and out. It also prevents tools on the pegs from sliding forwardly off the pegs 40 while preventing tools from falling off upwardly from the pegs 41.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A compact position lock tool box, comprising in combination, a case within which a plurality of tool holding compartments are formed; a cover pivotally connected to said case; hinge means pivotally connecting said cover to said case; said case having a pair of triangular shaped side walls, said hinges connecting said cover to said case at first ends of said pair of side walls, a low front wall connecting said side walls, a rear wall also connecting said side walls and spaced from said low front wall, said cover when in the closed position resting upon an edge of each of said pair of side walls; said case further comprising a first compartment means at the bottom thereof in vicinity of said front wall, said first compartment means having a hinged lid, said hinged lid comprising a plurality of first pegs extending perpendicularly upward parallel to said low front wall when said hinged cover is in a closed position, at least some of said plurality of first page abutting against said cover of said case when said cover is in a closed locking position so that said hinged lid is prevented from pivoting to an opened position, said first pegs serving to hold thereby a plurality of tools; a plurality of second pegs extending from the top of said rear wall toward said front wall and each of said plurality of second pegs inclined upwardly away from the bottom of said case and extending to close proximity of said cover when said cover is in its closed locked position, whereby said plurality of second pegs serve to hold tools and the like thereon; whereby when said cover is in its closed locked position, the tools contained within said case are prevented by said cover from falling off or out of their respective tool holding means if said case is accidentally overturned.

2. The compact position lock tool box according to claim 1, wherein said case further comprises a shelf fixedly attached between said pair of side walls, said shelf comprising a first section having a plurality of holes formed therethrough for receiving tools with a shank portion, and a second section comprising a second compartment means for storing therein a plurality of tools, and the like.

3. The compact position lock tool box according to claim 2, wherein said second compartment means comprises at least one partition between said pair of side walls, a rearward wall extending from said at least one partition to one of said pair of side walls thus forming a compartment for storage, and a top wall having one end thereof connected to the top of said rearward wall and extending upwardly at an angle from said rearward wall a distance less than the width of said shelf, whereby when said cover is in the closed locked position, it closes off said compartment of said second compartment means by flush engagement with said top wall and an edge of said shelf.

4. The compact position lock tool box according to claim 3, wherein said cover has a first leg extending at right angles to said rear wall of said case when said cover is in the closed position, and a second leg extending at an angle relative to said first leg in a direction toward said first compartment means when said cover is in the closed position, whereby the angle of said second leg relative to said first leg is equal to the angle a surface would make relative to the perpendicular extending between the front edge of said shelf to the front edge of said top wall of said second compartment means.

5. The compact position lock tool box according to claim 4, wherein said case further comprises a third compartment means fixedly suspended from the under surface of said shelf.

* * * * *